United States Patent [19]

Damiens

[11] Patent Number: 4,543,801

[45] Date of Patent: Oct. 1, 1985

[54] COOL BEVERAGE CARAFE SERVER

[76] Inventor: Bernard J. A. Damiens, 11, rue Emile Dubois, 75014 Paris, France

[21] Appl. No.: 675,830

[22] Filed: Nov. 28, 1984

[51] Int. Cl.[4] ..... F25D 3/08

[52] U.S. Cl. ..... 62/457; 62/1

[58] Field of Search ..... 62/457, 1, 56, 66, 372, 62/530, 430

[56] References Cited

U.S. PATENT DOCUMENTS

| | | | |
|---|---|---|---|
| 296,432 | 4/1884 | Moebius | 62/457 X |
| 1,771,186 | 7/1930 | Mock | 62/457 |
| 2,048,041 | 7/1936 | Warren et al. | 62/56 |
| 2,564,165 | 8/1951 | Magis | 62/457 |
| 2,629,515 | 2/1953 | Asplund | 62/1 X |
| 2,952,133 | 9/1960 | Miller | 62/1 |
| 3,065,606 | 11/1962 | Reynolds | 62/1 |

*Primary Examiner*—Lloyd L. King

*Attorney, Agent, or Firm*—Parmelee, Bollinger & Bramblett

[57] ABSTRACT

A cooled beverage carafe serving apparatus is provided for cooling and serving and for continued cooling of beverage while it is waiting to be served, particularly adapted for beverage of the so-called white alcohol types, such as vodka, which are not desired to be diluted. A carafe has an elongated neck extending upwardly from a rounded, convex curvature, bulbous body portion, and the neck acts as a handle in handling the carafe holding the beverage which is to be cooled and served. This full carafe is initially placed into a container (for acting as a mold) having a larger diameter than that of the bulbous body portion of the carafe, and the container is filled with water to a level considerably above the level of the largest cross-sectional dimension of the body portion. Since the bulbous body portion is almost spherical it may be considered to have an equator at a level approximately one half of the way up from the bottom of the region where the neck joins the body portion. The level of the water is far above this equator and is almost up to the level where the neck joins the body portion. In a freezer the water is frozen around the body portion of the carafe forming an integral solid ice ring encircling the carafe body portion and is removed from the mold intact with the carafe. The side wall of the mold diverges continually in the upward direction, approaching a truncated conical form for enabling removal of the solid ice ring intact from this mold.

3 Claims, 4 Drawing Figures

COOL BEVERAGE CARAFE SERVER

BACKGROUND OF THE INVENTION

This invention relates to an apparatus for cooling, serving, and continuing to cool the contents of a carafe along with a convenient tray having a screen supporting shelf for holding the cooled container when it is not being handled.

It has been customary to immerse bottle containers of beverage in buckets of ice in order to keep them cold. Wine and champagne bottles are often employed with this ice bucket technique, but such a bucket is a relatively large container. Such bottle in ice buckets are usually served by waiters having towels wrapped around the bottle for preventing moisture from dripping onto the table or onto patrons. The ice bucket itself is so large as to be not suitable generally for resting on the dinner table itself to be used directly by the drinkers. Instead of placement on the dinner table, the ice bucket is usually placed on a waiter's side table.

Several other approaches have been provided for cooling beverages. For example, Warren et al in U.S. Pat. No. 2,048,041 show a method of packing cracked ice around an inverted drinking glass. After the ice has been packed around the inverted glass, a napkin pad with a saucer are placed over the mass of cracked ice to hold it in place, while it and the glass are turned upright. Cracked ice, since it has no structural integrity, must be arranged in a tapered mass which is larger at the bottom than the top. In this cracked ice arrangement the user is unable to pick up the glass and must drink the beverage through a drinking straw. The napkin pad is now underneath the mass of cracked ice and must remain there in an unattractive fashion.

Another approach is shown by Miller in U.S. Pat. No. 2,952,133 wherein there is a drinking glass preformed of solid ice. The ice may be colored or flavored or may contain small sprigs of leaves or bits of decorative fruit. The ice glass is pre-molded, and the user must hold an unattractive corrugated, double-walled paper cup with an absorbent liner which surrounds and contains the bottom half of this drinking glass made of ice. In addition to the problem of this awkward insulated paper cup, the melting ice will dilute and alter the flavor of the beverage contents.

Schmid in U.S. Pat. No. 1,635,438 utilizes a preformed ice cap which rests over the lid of a milk bottle. This ice cap keeps the bottle cool in its top portion while being delivered to the user and while resting on a porch. Not only does the melting ice drip down the side of the bottle onto the floor, but also the dripping water makes the bottle difficult to handle and slippery, and the user cannot grasp the bottle by its rim or neck portion when the ice cap is in place.

SUMMARY OF THE INVENTION

Accordingly, it is an object of this invention to provide a new and improved apparatus for cooling, serving, and for continued cooling and storage of a beverage particularly for a white alcohol beverage desired not to be diluted while it is being consumed and while waiting until consumption is finished.

Another object of this invention is to provide a new and improved apparatus which is convenient, attractive and adds elegance as well as enjoyment in providing cooled white alcohol beverages for guests.

Another object of this invention is to provide a new and improved apparatus for carafe serving of ice cold white alcohol beverages which may be used at the dinner table without the assistance of waiters and which is attractive, elegant and convenient and is extremely effective in not only cooling, but maintaining the beverage at reduced temperature levels without any dilution whatsoever so that the chilled liquid may be enjoyed at those reduced temperatures over extended time periods.

In carrying out this invention in the illustrative embodiment thereof, a carafe having an elongated neck portion, which is suitable to be hand held as the handle for the carafe, extends up from a rounded, convex curvature bulbous body of approximately spherical configuration containing the liquid contents which are to be cooled in the carafe and served from the carafe. The full carafe is initially placed in a container which acts as a mold for forming an ice ring encircling that body. This mold has a larger diameter than the largest cross-sectional dimension of the body of the carafe and it is filled with water up to a level considerably exceeding the level of the largest cross-sectional dimension of the body. Thus, the water level extends considerably above the equator of the body portion of the carafe. The whole assembly is placed in a freezer so that the water becomes frozen around the body of the carafe forming an integral solid ice ring around it. The carafe with its integral solid ice ring is removed from the mold with the ice ring intact. The side wall of the mold diverges continually upwardly throughout its extent, generally being of a truncated conical configuration, for enabling removal of the integral ice ring intact from this mold. The ice cold beverage is now ready to be served by holding the neck of the carafe without touching the integral solid ice ring. After serving, the carafe still carrying its ice ring captured thereon in encircling position is positioned on a support screen mounted in a tray which has volume sufficient to collect and hold the total volume of water from the melting integral solid ice ring. The beverage remains ice cold but is not diluted.

Conveniently, the user may grasp the carafe by the neck and pour its chilled contents without coming into contact with nor touching the solid ice ring around the carafe. Serving may take place by the user who may actually serve the beverages over the tray so that any water dripping from the solid ice ring will conveniently drip into and be contained in the screen covered holding tray.

BRIEF DESCRIPTION OF THE DRAWINGS

The invention, together with other objects, features, aspects and advantages thereof will be more clearly understood from the following description considered in conjunction with the accompanying drawings.

DESCRIPTION OF THE PREFERRED EMBODIMENTS

Figure 1:
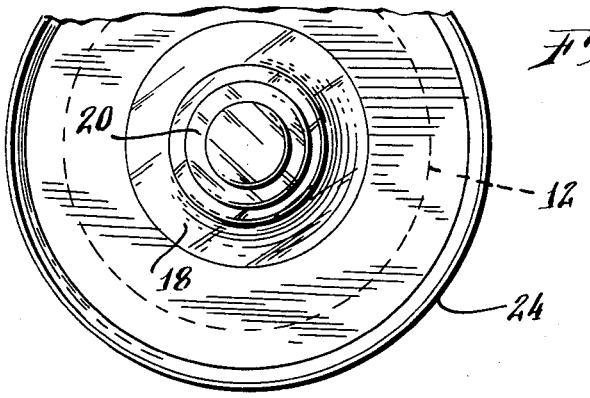
FIG. 1 is a top plan view of the carafe sitting in its water-filled mold as shown in FIG. 2 for forming the ice ring.
Figure 2:
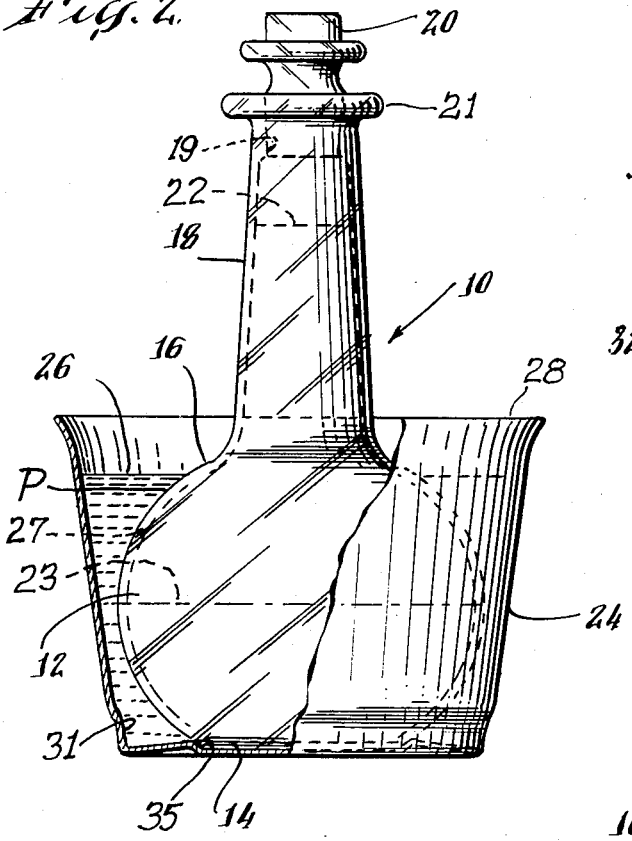
FIG. 2 is a front elevational view with part of the mold shown in section. This mold holds water in which the full carafe is initially placed before freezing this water into an ice ring in accordance with the present invention.
Figure 3:
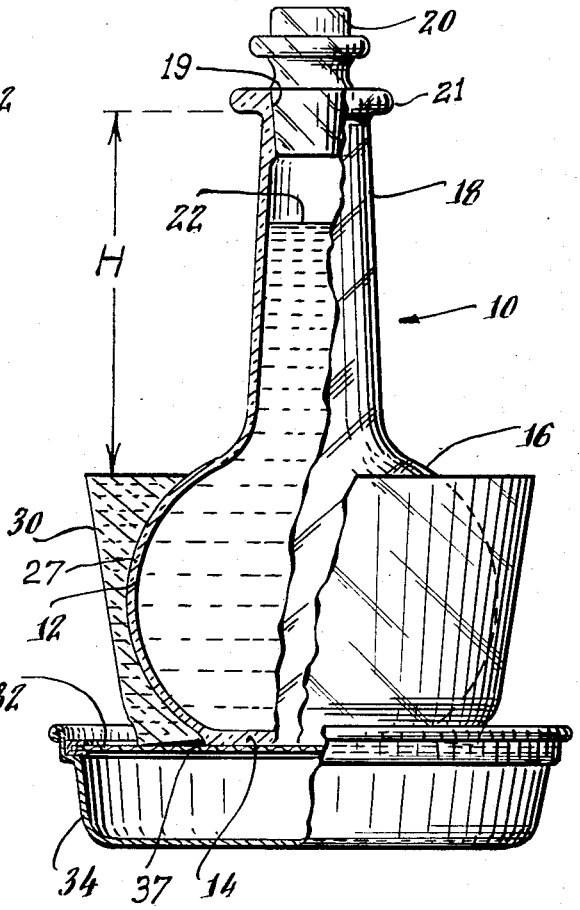
FIG. 3 is a front elevational view showing the body portion of the carafe captured in an integral solid ice ring. The carafe is resting on a screen-covered tray ready for serving, with portions of the carafe, the ice ring and the screen tray being shown in section.
Figure 4:
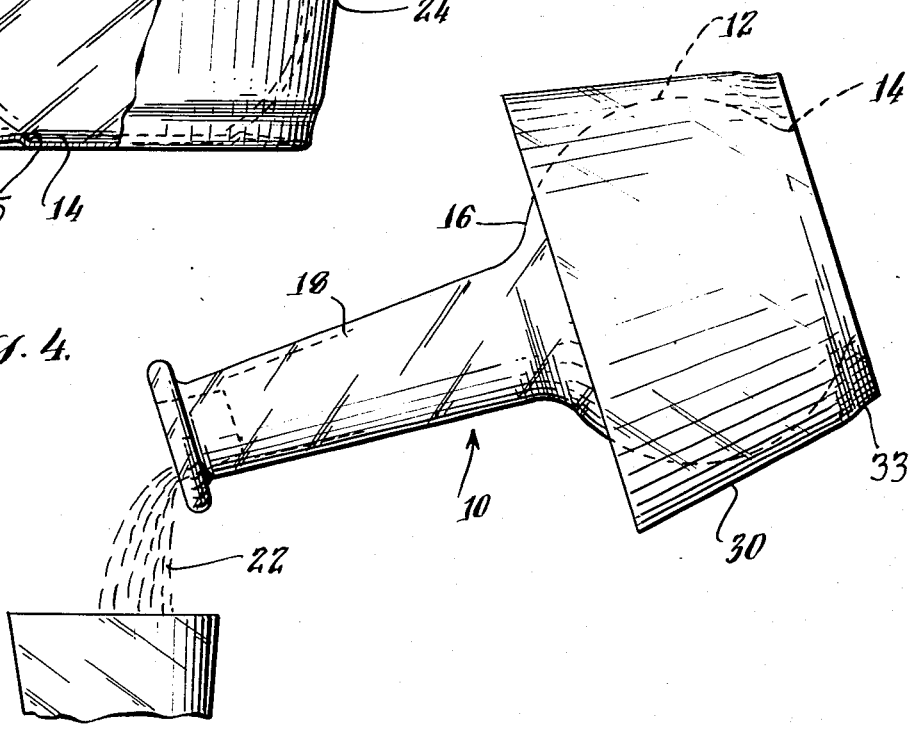
FIG. 4 illustrates the convenient and elegant serving of a cooled beverage in accordance with the present invention.

Referring now to FIGS. 1 and 2, a carafe referred to generally by the reference numeral 10, is made of transparent glass and has a main bulbous body portion 12 with a bottom or base 14 and with a converging upper body portion 16 having an elongated neck 18 extending up therefrom to the mouth 19 of the carafe which carries in the upper end thereof a removable stopper 20. Although the carafe 10 may take various shapes and sizes depending on the amount and type of beverage which is to be stored and cooled and served therein, as will later be explained, it is required by this invention to have an elongated neck 18 which may conveniently be hand-held as a handle. As enlarged rim 21 around the mouth 19 enhances the user's grip on the neck 18. Also, it is required that the main body portion 12 have a bulbous shape such that it will retain a solid ice ring captured thereon in encircling relationship. More specifically, the main bulbous body 12 has a rounded, convex curvature of generally spherical configuration with an equator 23 at the level where the body 12 has its maximum horizontal diameter parallel with the plane of the base 14. This equator 23 is located about half way between the base 14 and an upper level 16 where the upper portion of the bulbous body 12 is curving inwardly having an exterior tangent slope at an angle of less than 45° to the horizontal where the wall of the body 12 is converging toward the nearby lower end of the neck 18. This overall configuration of the carafe is critically important as being the very configuration which enables the ice ring to be retained captured around the body of the carafe in encircling relationship as shown in FIGS. 3 and 4.

Such a carafe often has a liquid-containing volume of ¼ liter, which is almost equal to 8.5 U.S. liquid ounces or about one cup liquid measure, or has a volume of ½ liter, almost equal to 17 U.S. liquid ounces or about one pint liquid measure.

The user fills the carafe with a white alcohol beverage 22, for example, vodka and inserts the stopper 20. Then, the bulbous body 12 is placed down into a water-filled mold 24 which holds water 26 up to a level considerably above the equator 23. Thus, the surface of the water 26 is near the upper body level 16, namely above the point "P" where the tangent slope of the exterior surface of the glass wall 27 is 45° (hereinafter called "the point of 45° exterior tangent slope").

The rim 28 of the mold 24 is at a height above the location of the lower end of the neck 18 for conveniently holding water 26 up near to the upper body level 16. The mold 24 at each interior region has a diameter which is larger than the exterior surface of the bulbous body 12 for providing clearance in which to freeze an integral ice ring.

The side wall of the mold 24 diverges continually in the upward direction, approaching a truncated conical form for enabling intact removal of an integral ice ring. The side wall of the mold close to the bottom has a small gentle interior annular step 31 for shaping an attractive reduced border 33 (FIG. 4) around the outside lower margin of the ice ring 30.

In order to center the axis of the carafe concentric with the axis of the mold 24, the bottom of the mold has an inwardly facing annular shoulder 35 (FIG. 2) which engages an outwardly facing annular shoulder 37 (FIG. 3) of the bottom 14. The whole assembly of beverage-filled carafe, mold and water is then placed into a freezer for freezing the water 26 thereby forming a solid ice ring 30, as is clearly illustrated in FIGS. 3 and 4. The temperature of the freezer is below 0° C. (32° F.) but is above that temperature which would solidify the white alcohol beverage 22.

After freezing, the carafe with its integral solid ice ring 30 captured thereon is then removed from the mold 24 and is placed on a support screen or grille 32 mounted in the top of a tray 34. The ice ring is captured in position on the body embracing above and below the bulbous equatorial region 23.

The tray 34 is large enough to contain the entire volume of water 26 from the melting solid integral ice ring 30. The cold beverage may then be poured from the carafe 10 by removing the stopper 20 from the carafe and using the neck 18 as a handle as will be understood from FIG. 4.

In order to provide a convenient grip for the user's hand, the neck rim 21 is spaced at a distance H (FIG. 3) above the intended top surface of the ice ring 30 which is adequate for spanning a human hand so that the heel and wrist portions of the hand do not come into contact with the ice ring 30.

With the carafe 10 and its captured encircling integral ice ring being placed upon the screen 32 of the serving tray 34, water from the melting ice can flow down through the screen 32 to be accumulated in the bottom of the tray 34 which has sufficient capacity to contain all of the water originally frozen in the solid ice ring 30.

By virtue of the fact that the ice ring 30 is formed over above and below the equator 23 of the body portion 16 that body portion captures and holds the ice ring which is integral and has sufficient structural strength to support its own weight during serving, as seen in FIG. 4. A very convenient and attractively elegant ensemble of ice ring and transparent glass wall 27 has been created as seen in FIG. 4.

The tall elongated narrow neck 18 of the carafe extends above the level of the ice ring 30 and thereby may be used as a handle for serving pouring of the chilled beverage 22 into a drinking glass 36 as illustrated in FIG. 4. Since the neck 18 of the carafe 10 extends a distance H above the solid ice 30, it is not necessary for the server to come into contact with the cold ice when pouring a drink. Furthermore, since the tray 34 is positioned directly on the table in front of the server, the pouring may in fact be done over the tray so that even if there is some small dripping during the moment it takes to pour, such dripping will be caught in the tray. As discussed in the introduction, convenient placement of the ice container on the dinner table is just not feasible when using ice buckets, and the present invention provides the convenience of having the iced carafe on the table near the host with a convenient handle in the form of a neck for pouring and readily holding the carafe during serving. As soon as the pouring is terminated, the user places the carafe upright back on the tray 34 where it continues to be kept cool by the ice ring.

Accordingly, a very unique, attractive, convenient method and apparatus are provided for serving an ice cold beverage without dilution of the beverage, which is particularly desired for white alcohol beverages such as vodka, for maintaining the beverage at reduced temperatures while it is being served, and yet permitting the user to handle the carafe containing the cold drink without requiring extra towels or a waiter to do the pouring.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A cooled beverage serving system for cooling, serving and continuing to cool a beverage without dilution while the beverage is awaiting being served comprising:

a carafe for holding the beverage which is to be cooled without dilution, said carafe having an elongated neck extending up from a bulbous body portion capable of being hand held by said neck, said body of the carafe has a bottom with an outwardly facing annular shoulder, a mold having a cross-sectional area sufficient to house the body of said carafe immersed in water to a level above the equatorial region of said bulbous body, said mold having a side wall diverging upwardly outwardly at all levels therein and having a rim height spaced above the equatorial region of said body, said mold has an inwardly facing annular shoulder complementary to the bottom shoulder for centering the carafe in alignment with the axis of the mold for causing the body of the carafe to be centered within said ice ring, said mold, and water and carafe being adapted for placing in a freezer for the water contained therein to be frozen around said carafe forming an integral ice ring captured in embracing relationship above and below the bulbous equatorial region of the body of said carafe, and a serving tray having a suspended support spaced above the tray bottom adapted to have said carafe and its integral ice ring rest thereon on a dinner table for collecting the water from the melting ice ring on said carafe, while said carafe is resting thereon awaiting serving.

2. A cooled beverage serving system as claimed in claim 1, in which:

the side wall of the mold close to the bottom has a small gentle interior annular step for shaping an attractive border of reduced diameter around the lower margin of said ice ring.

3. The cooled beverage serving system as claimed in claim 1, in which:

said bulbous body portion of the carafe has a point P on its exterior surface above the level of the equitorial region and a plane tangent to the exterior surface at point P slopes at an angle of 45° to the horizon, and the body portion of the carafe is immersed in water to a level above point P.

* * * * *